United States Patent [19]

Noser

[11] Patent Number: 4,621,387

[45] Date of Patent: Nov. 11, 1986

[54] DENTAL BRUSHING AID

[76] Inventor: Anne M. Noser, 1229 West Center St., Rochester, Minn. 55901

[21] Appl. No.: 764,732

[22] Filed: Aug. 12, 1985

Related U.S. Application Data

[60] Division of Ser. No. 572,834, Jan. 23, 1984, Pat. No. 4,558,483, which is a continuation-in-part of Ser. No. 467,785, Feb. 18, 1983, abandoned.

[51] Int. Cl.[4] ..... A46B 5/02; A46B 15/00

[52] U.S. Cl. ..... 15/167 R; 15/143 R; 15/248 R; 128/359; D4/104

[58] Field of Search ..... 15/143 R, 145, 146, 15/248 R, 167 R, 118; 128/359, 360, 62 A, 67; 604/1; 211/65; 248/110, 205.2; 24/34, 442; 224/901; D4/104

[56] References Cited

U.S. PATENT DOCUMENTS 3,370,818 2/1968 Perr ..... 24/442 X
3,800,939 4/1974 Cornelius ..... 224/901

FOREIGN PATENT DOCUMENTS 2067069 7/1981 United Kingdom ..... 15/110 X

*Primary Examiner*—Peter Feldman
*Attorney, Agent, or Firm*—Dean P. Edmundson

[57] ABSTRACT

A dental brushing aid is described comprising (a) a handle means, (b) a terminal end portion carried by the handle means, and (c) an enlarged portion disposed between the gripping portion of the handle and the terminal end portion to prevent the end of the brushing and from blocking the air passage of a user of the aid. The end portion of the brushing aid includes brush means comprising bristles radiating outwardly from all sides.

11 Claims, 9 Drawing Figures

DENTAL BRUSHING AID

CROSS-REFERENCE TO RELATED APPLICATION

This application is a division of my copending application Ser. No. 572,834, filed Jan. 23, 1984, now U.S. Pat. No. 4,558,483, which is a continuation-in-part of my copending application Ser. No. 467,785, filed Feb. 18, 1983, now abandoned.

FIELD OF THE INVENTION

This invention relates to oral hygiene aids. More particularly, this invention relates to dental brushing aids for geriatric persons, physically or mentally handicapped persons, or other persons who cannot safely or effectively utilize conventional brushing aids.

BACKGROUND OF THE INVENTION

Existing toothbrushes adequately serve the intended purposes for the majority of the population, but such toothbrushes are not necessarily adequate for an important increasing segment of the population; namely, the elderly, the physically handicapped, and others; who often are unable to properly and safely utilize existing toothbrushes. Elderly and physically handicapped persons often are victimized by loss or diminution of muscle control in their extremities, tremors, stiffness in their joints, and poor eyesight. Consequently, even a task as seemingly simple as brushing their own teeth may become extremely difficult or impossible in addition to being hazardous if they should happen to insert the end of a toothbrush into their throat.

The mentally handicapped, and others who cannot safely or effectively utilize conventional brushing aids (e.g. small children), often must rely upon another person to attend to the proper brushing of their teeth, or perform the task themselves in an inadequate (and possibly unsafe) manner.

It has also been recognized that proper dental hygiene also includes proper care of the gums as well as the teeth. It is further recognized that the elderly lose more teeth as a result of gum disease than because of tooth decay.

Existing toothbrush designs have not been able to meet the needs of geriatric persons, physically or mentally handicapped persons, or other persons who for one reason or another cannot safely or effectively utilize conventional brushing aids.

Although others have proposed various modifications of toothbrush designs, insofar as is known such proposals have not been commercially acceptable and do not meet all of the needs of the elderly, handicapped, or children. For example, in U.S. Pat. No. 3,753,266 there is described an oral hygiene device for children which essentially comprises a conventional toothbrush in which the handle has been made wider and in the form of a teething member. While this brush may be safer for infants, it does not provide the advantages associated with my invention. U.S. Pat. No. 4,328,604 describes a modified brush design which does not include safety features. U.S. Pat. No. 1,813,076 describes a brush having bristles at each end thereof. U.S. Pat. No. 4,115,893 describes a gum brush for infants. U.S. Pat. No. 2,115,405 describes a teething device, and U.S. Pat. No. Des. 219,631 shows a teether/pacifier combination. None of the foregoing devices provides the utility and safety afforded by the device of the present invention.

SUMMARY OF THE INVENTION

In accordance with the present invention there is provided a dental brushing aid comprising:

(a) handle means including an easily graspable gripping portion;

(b) a terminal end portion, carried by said handle means, including brush means substantially circumferentially surrounding said end portion;

(c) an enlarged portion disposed between said gripping portion and said end portion which is adapted to prevent said end portion from travelling into the throat of a user of the aid; i.e., to prevent blocking of the air passage of the user.

This novel brushing aid is easily held and a relaxed grip is adequate to maintain control, even by elderly or handicapped persons. It is also of sufficient size to be easily seen by persons having poor eyesight. Because the brush portion of the aid substantially circumferentially surrounds the terminal end portion, the user obtains the benefits and advantages of brushing without having to maintain any required orientation of the brush portion.

In another embodiment the invention provides a dental brushing aid in which a second enlarged portion is disposed at the opposite end of the handle means away from the terminal end portion. This embodiment is particularly adaptable for use by mentally handicapped persons and children since it is easily grasped and held, and the two enlarged portions prevent either end of the aid from extending into the user's throat. Of course, this embodiment is also useful for geriatric and physically handicapped persons.

BRIEF DESCRIPTION OF THE DRAWINGS

The invention is described in more detail hereinafter with reference to the accompanying drawings wherein like reference characters refer to the same parts throughout the several views and in which.

DETAILED DESCRIPTION OF THE INVENTION

Figure 1:
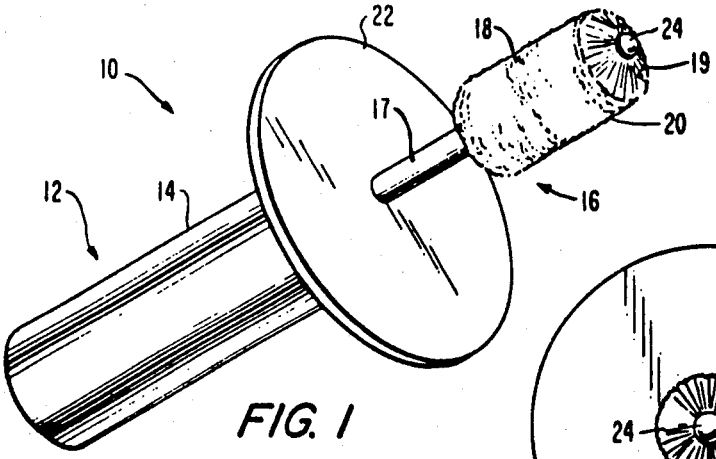
FIG. 1 is a perspective view of one embodiment of dental brushing aid of the invention.
Figure 2:
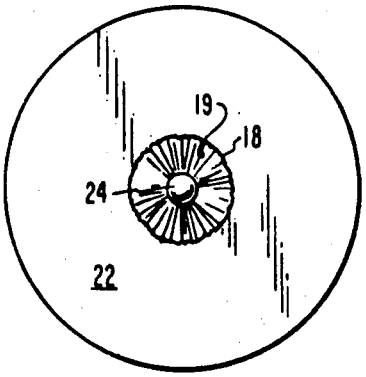
FIG. 2 is a top view of the embodiment of FIG. 1.

In FIGS. 1 and 2 there is shown one embodiment of a dental brushing aid 10 including handle means 12, terminal end portion 16 and brush means 18. Handle means 12 includes an easily graspable gripping or holding portion 14.

By "easily graspable" is meant that the gripping or holding portion of the handle is sufficiently large and so shaped and formed that the handle may be readily held by the hand of a user regardless of age or mental or physical infirmities. With this feature in mind, the gripping portion may be, for example, cylindrical, ribbed (with either longitudinal or horizontal ribs), oval in cross-section, cylindrical with one or more flat sides, a plurality of bars or rods aligned in spaced apart parallel relationship, and so forth.

The handle may be made of various materials, although rubber and break-resistant plastic are preferred. As another variation, the handle may have a relatively rigid central core (such as wood, plastic, metal, rubber, or the like) which is covered with a soft material such as sponge or pliable rubber. When the brushing aid is intended for use by small children, it may be desirable to include a noise making device in the handle; e.g., a bell, or to make the handle toy-like to encourage use of the device, or to use bright colored materials in the construction of the device.

The handle may be made extremely light in weight (e.g. by being hollow) or it may be weighted in any particular manner desired, depending upon the intended use of the brushing aid. The handle may be made of clear plastic if desired and may be filled with non-toxic edible liquid, for example. Various decorations or figures may also be included on the handle.

The diameter of the handle is typically, and preferably, in the range of about 0.75 to 2.5 inches in order to facilitate easy grasping and holding by a user. The length of the handle may vary, depending upon whether the brushing aid is intended for use by an adult or a smaller person, but generally will be in the range of about 2.5 to 5 inches.

Terminal end portion 16 is carried by handle 12 and may be, for example, in the form of, or which includes, a central stem 17 which is preferably coaxially aligned with handle 12. Stem 17 is preferably made of rubber or plastic and is generally in the range of about 0.75 to 2.5 inches long. If the brushing aid is to be used by small children, it is preferred that the length of the stem 17 not exceed about one inch.

Brush means 18 is carried by end portion 16 and substantially circumferentially surrounds end portion 16. Preferably brush means 18 completely surrounds end portion 16 as shown in the drawings. When the brush means comprises bristles it is preferred that no bristles project outwardly from the terminus of, the stem directly away from the handle, for safety reasons. When the brush means is composed of a non-bristle cleaning material (e.g. a sponge or woven or non-woven brush material), the brush means may completely cover the terminus of the stem.

Figure 3:
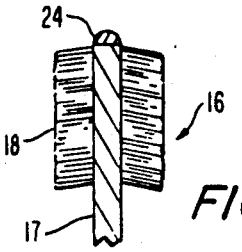
FIG. 3 is a cross-sectional view of the end portion of the dental brushing aid of the invention.

Brush means 18 may be any material which is effective in cleaning teeth. Currently preferred materials are conventional plastic bristles 19 of the type commonly employed in commercially available toothbrushes, such as soft nylon bristles having rounded exposed ends. Hog hair or other conventional materials may also be used. As shown in FIG. 3, it is preferred that the bristles 19 radiate outwardly from the central stem 17 essentially parallel to each other and that the exposed ends 20 of bristles 19 project rearwardly at an angle toward handle means 12. When the bristles project rearwardly toward the handle a simple in-and-out movement of the brushing aid can be used to obtain thorough brushing of the teeth. Consequently, exacting movement of the brushing means as required when using conventional toothbrushes is obviated with the use of the brushing aid of this invention.

Figure 6:
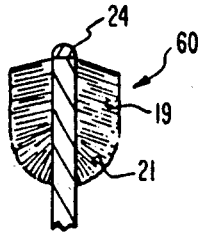
FIG. 6 is a cross-sectional view of the end portion of another embodiment of brushing aid of the invention.

In a more preferred embodiment, shown in FIG. 6, the bristles 21 at the lower end of brush means 60 (i.e. on the side of the brush means closest to the handle) project toward the handle at increasingly more acute angles. The bristles nearest the handle are nearly longitudinally disposed.

With the arrangement of bristles shown in the accompanying drawings the bristles are more likely to thoroughly clean the back side of the user's teeth even when the brush is moved directly in and out of the mouth without up and down movement of the brush. In an alternative embodiment the bristles may project outwardly essentially perpendicular to stem 17. In another embodiment the bristles may project outwardly from the stem at a slight angle away from the handle, if desired.

The bristles may be aligned in rows around the stem, in vertical rows along the stem, or randomly on the stem. The bristles may also be helically disposed around and along the stem. The bristles may be all of the same length or they may be of differing lengths. In one embodiment the bristles may be of alternating lengths, either by horizontal rows or by vertical rows.

The length of the bristles, measured from the surface of the stem outwardly, is generally in the range of about 0.25 to one inch. The shorter lengths are more suitable when the brushing aid is intended for use by children or persons taking medication of the type which causes swelling of the tongue.

Enlarged portion 22 is disposed between gripping portion 14 and end portion 16 and is adapted to prevent end portion 16 from travelling into the throat of the user of the brushing aid and thereby blocking the air passage. Preferably portion 22 is integral with the handle means 12 but it is not necessary for this to be so. Enlarged portion 22 may be of any shape and form so long as it does not include sharp points or corners which may cause injury when the brushing aid is put to its intended use. For example, portion 22 may be circular, oval, ball shaped, polygonal, etc. The surfaces and edges of portion 22 may be smooth, undulating, etc. When the brushing aid includes two enlarged portions they may be the same or different.

Portion 22 is presently preferred to be in the form of a disc disposed perpendicularly with respect to handle 12 and is of a size larger than a person's mouth so that it cannot enter the mouth. Typically portion 22 has at least one dimension which is at least about two inches. Larger sizes of course may also be used, particularly for adults. For example, portion 22 may have at least one dimension up to about four inches.

It is preferred to have a safety cap 24 covering the terminus of central stem I7 so that no sharp edges or points are exposed. Cap 24 may be rubber or plastic, for example, and may be fastened to stem 17 in any suitable manner (such as solvent welding, adhesive, threaded engagement, and so forth).

Figure 4:
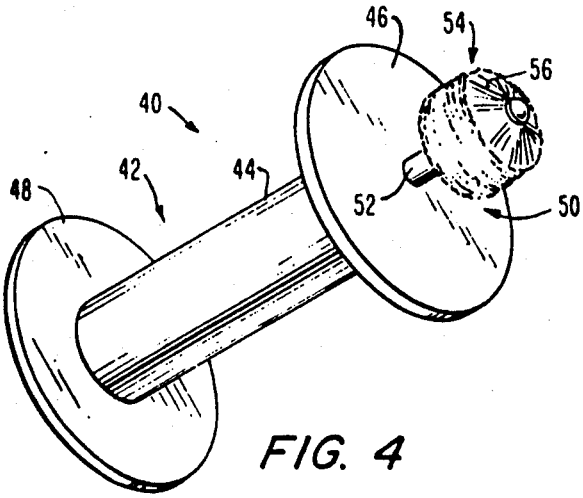
FIG. 4 is a perspective view of another embodiment of the invention.

In FIG. 4 there is shown a side view of another embodiment of dental brushing aid 40 of the invention. This embodiment is particularly suitable for use by children or mentally handicapped persons. Brushing aid 40 comprises handle means 42 including easily graspable gripping portion 44. Enlarged portion 46 is located between gripping portion 44 and brush means 54. Enlarged portion 48 is located near the opposite end of handle 42. Preferably enlarged portions 46 and 48 are discs which are integral with handle 42 and are disposed perpendicularly thereto. The portions 46 and 48 are preferably at least about two inches in diameter when the brushing aid is intended for use by children. Portions 46 and 48, as well as handle 42, are preferably made of rubber or impact resistant plastic so as to minimize the potential for sharp broken edges. The rubber or plastic may be clear or brightly colored. If desired, portions 46 and 48 may be filled with non-toxic edible gel. Enlarged portion 46 may also contain ventilation apertures or openings therethrough so that portion 46 does not interfere with the breathing of a child under any circumstances. For example, even if a child should fall asleep with the brushing aid in the mouth, the enlarged portion 46 will not interfere with breathing. The apertures or openings are preferably at least 0.2 inch in diameter or in their minor dimension. Preferably the apertures are symmetrically located around portion 46, and preferably the edges of the apertures are no closer than about 0.2 inch to the perimeter of portion 46. If desired, enlarged portion 46 may instead be curved or angled away from the brush head so as to provide for good ventilation.

Preferably end portion 50 includes a central stem 52 which is coaxially aligned with gripping portion 44. Brush means 54 preferably comprises bristles 56 which are anchored to stem 52 and radiate outwardly therefrom at an angle projecting toward handle means 42. Preferably bristles 56 radiate outwardly from all sides of stem 52, as shown in FIG. 4.

Figure 5:
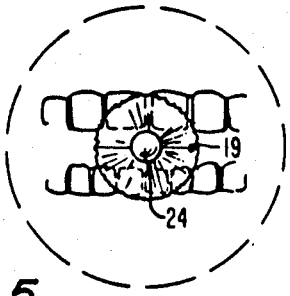
FIG. 5 is an end view of the brushing aid of the invention showing the manner in which the brush means intersects with the teeth of a user.

In FIG. 5 there is shown an end view of a brushing aid of the invention from inside the user's mouth. This view shows the manner in which bristles 19 interact with the back surfaces of the teeth (i.e. inside the mouth) when the brushing aid of either FIG. 1 or FIG. 4 is removed from the mouth. The bristles, which are ordinarily angled toward the handle, fan outwardly against the back surfaces of the teeth so as to cover an area greater than the cross-sectional area of the brush means at rest.

Other variations of the brushing aid are also possible. For example, it may be brightly colored to make it easier to see and to be more attractive to children, or it may be adapted to be electrically powered so as to impart either rotary or reciprocal motion to the brush means. Still other variants are possible without departing from the scope of this invention.

The dental brushing aid shown in FIG. 4 is also useful as a child development toy. Infants are able to grasp objects and put them into their mouth by the time their primary teeth appear. Accordingly, playing with the brushing aid results in the brush head being inserted into the mouth. Chewing on the brush head is beneficial during teething and establishes good oral hygiene habits before the infant reaches two years of age where independence is often asserted. Further, the design of the brushing aid is such that if it is laid on the floor or other surface, the brush means is supported off the surface so that it will not become dirty.

Figure 8:
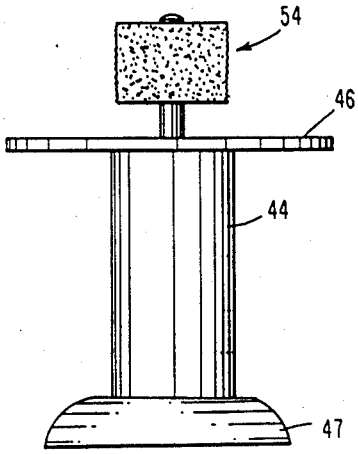
FIG. 8 is a side view of another embodiment of a brushing aid of the invention.

The dental brushing aids of this invention may also be used by persons who can only control their neck and jaw muscles. For example, the dental brushing aid may be mounted on a suitable support so that the user moves his or her head relative to the brush means. If desired, a mounting means such as a suction cup 47 (as illustrated in FIG. 8) may be affixed to the end of the brushing aid (opposite the brush end) so as to facilitate mounting of the brushing aid to a wall or other suitable support structure.

The brushing aid of the invention is extremely safe, but still effective, for use by persons who lack normal adult faculties. Accordingly, little or no supervision of the user is required. Such a device has not heretofore been proposed.

In yet another variation the brush means may be detachably mounted to the handle so that one type of brush means may be detached and replaced with another type of brush means, if desired. For example, the stem (to which the brush means is attached) may be threadably secured to the handle or it may be slidingly received in an appropriate slot in the handle. Various means may be used in order to render the attachment of the brush means childproof. For example, detachment may require the stem to be pushed inward with considerable force and then rotated in a specific manner in order to become detached from the handle.

Figure 7:
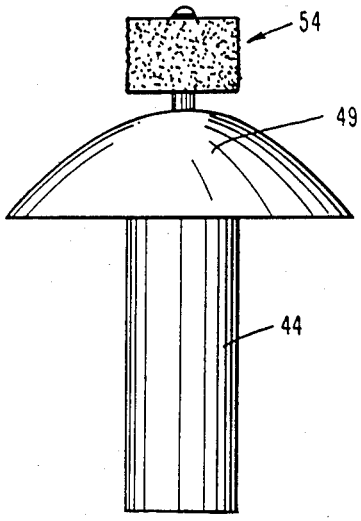
FIG. 7 is a side view of another embodiment of a brushing aid of the invention.
Figure 9:
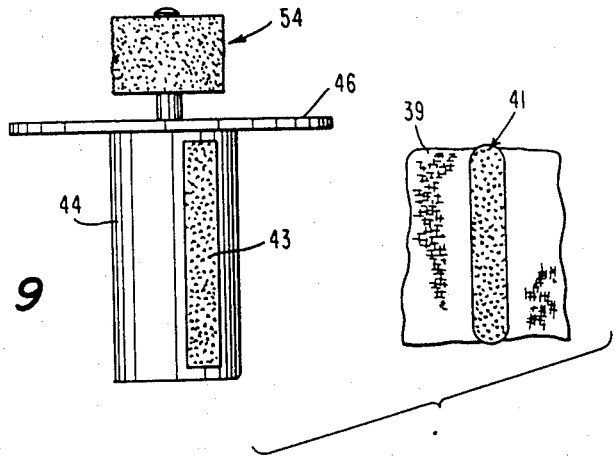
FIG. 9 illustrates use of another embodiment of a brushing aid of the invention.

In still another variation (shown in FIG. 9) the handle may be provided with a hook and loop fastener material 43 (e.g., "Velcro," which is commercially available) so that the handle may be securely retained and grasped, e.g., by geriatric persons having mating fastener means 41 on their hands such as on a glove or mitten 39. Alternatively, the mating fastener means may be secured to the desired support surface. In yet another variation (shown in FIG. 7) the disc-shaped member 49 may be sloped away from the brush means 54.

What is claimed is:

1. A dental brushing aid comprising:

(a) handle means including an easily graspable gripping portion;

(b) a terminal end portion, carried by said handle means, including brush means substantially circumferentially surrounding said end portion wherein said terminal end portion includes a central stem, and wherein said brush means comprises bristles radiating outwardly from all sides of said stem;

(c) an enlarged portion disposed between said gripping portion and said end portion, said enlarged portion being adapted to prevent said end portion from blocking the air passage of a user of the aid.

2. A dental brushing aid in accordance with claim 1, wherein said stem and said handle means are coaxially aligned.

3. A dental brushing aid in accordance with claim 1, wherein said bristles radiate outwardly from said stem at an angle toward said handle means.

4. A dental brushing aid in accordance with claim 1, wherein said enlarged portion comprises a disc-shaped member carried by said handle means.

5. A dental brushing aid in accordance with claim 1, wherein the terminus of said stem is covered by a cap.

6. A dental brushing aid in accordance with claim 1, wherein said gripping portion of said handle means is cylindrical.

7. A dental brushing aid in accordance with claim 1, wherein said gripping portion of said handle means has a diameter in the range of about 0.75 to 2.5 inches; wherein said stem has a length in the range of about 0.75 to 2.5 inches; and wherein said bristles have a length in the range of about 0.25 to one inch.

8. A dental brushing aid in accordance with claim 4, wherein said disc-shaped member is sloped away from said brush means.

9. A dental brushing aid in accordance with claim 1, further comprising mounting means carried by said handle means, wherein said mounting means is adapted to mount said brushing aid to support structure.

10. A dental brushing aid in accordance with claim 9, wherein said mounting means comprises a first fastener means which is adapted to mate with a second fastener means carried by said support structure.

11. A dental brushing aid in accordance with claim 10, wherein said first and second fastener means comprise a hook and loop fastener.

* * * * *